US006308335B1

(12) United States Patent
Colorado

(10) Patent No.: US 6,308,335 B1
(45) Date of Patent: Oct. 30, 2001

(54) EXTRICATION HARNESS APPARATUS HAVING SUSPENDER ASSEMBLY

(76) Inventor: Juancarlos Colorado, P.O. Box 2111, Petaluma, CA (US) 94953

( * ) Notice: Subject to any disclaimer, the term of this patent is extended or adjusted under 35 U.S.C. 154(b) by 0 days.

(21) Appl. No.: 09/616,099

(22) Filed: Jul. 14, 2000

Related U.S. Application Data

(63) Continuation-in-part of application No. 09/352,664, filed on Jul. 8, 1999, now Pat. No. 6,105,169.
(60) Provisional application No. 60/092,328, filed on Jul. 8, 1998.

(51) Int. Cl.[7] ..... A41D 1/06; A47L 3/04
(52) U.S. Cl. ..... 2/81; 182/6
(58) Field of Search ..... 2/81, 79, 227; 186/6

(56) References Cited

U.S. PATENT DOCUMENTS 2,647,293 * 8/1953 Wintercorn ..... 2/81
4,378,921 * 4/1983 Allen et al. ..... 244/151 R
5,036,548 * 8/1991 Grilliot ..... 2/81
5,136,724 * 8/1992 Grilliot et al. ..... 2/81
5,145,027 * 9/1992 Petzl et al. ..... 182/3
6,105,169 * 8/2000 Colorado ..... 2/81

* cited by examiner

*Primary Examiner*—Bibhu Mohanty
(74) *Attorney, Agent, or Firm*—Douglas E. White

(57) ABSTRACT

A harness strap assembly is adapted to be incorporated into the inner liner of the pants of a firefighter's turnout suit without requiring structural modification thereof. The harness strap assembly, when installed, comprises a single length of webbed strap (or, preferably, a securely interconnected bifurcated length) that is wound forward around the user's waist through waist belt-loops suspended from a suspender assembly; then down through loops suspended at the crotch of the pant liner; thence back around under the user's buttocks; then through loops suspended at both thigh areas of the liner; and finally back forward to the fly area of the liner. Adjacent to the fly of the liner, the crotch portions of the strap pass through a pair of metal or fabric carabiner-holding rings that are attached to the ends of the harness strap. The carabiner-holding rings, in turn, are interlinked (by means of a strap) with a metal carabiner of conventional design.

16 Claims, 4 Drawing Sheets

EXTRICATION HARNESS APPARATUS HAVING SUSPENDER ASSEMBLY

CROSS REFERENCE TO RELATED APPLICATIONS

This application claims the benefit of U.S. Provisional Application No. 60/092,328 filed Jul. 8, 1998, and is a continuation-in-part of U.S. application Ser. No. 09/352,664 filed Jul. 8, 1999 now U.S. Pat. No. 6,105,169, which latter application is now pending. The entire disclosure of U.S. application Ser. No. 09/352,664 is considered to be a part of the disclosure of this application and is hereby incorporated by reference herein.

FEDERALLY SPONSORED RESEARCH OR DEVELOPMENT

Not applicable.

FIELD OF THE INVENTION

This invention relates to firefighters' turnout suits, more particularly, to turnout pants into which is integrated a self-adjusting climber's harness.

BACKGROUND OF THE INVENTION

Firefighters may become entrapped in the upper floors of a multistory building with no internal means of escape. Many tragically have become severely burned, or even killed, as a result. On such occasions, it is known to use a rope and an emergency climbing harness to rappel down to the ground, or at least to a lower floor which is not burning or is otherwise safe. However, such equipment is bulky and therefore not always brought by the firefighter into the building. Even when it is available, in an emergency situation it can be difficult and time consuming to put on, because the firefighter may be running low on oxygen, and smoke and the lack of electric light may be obscuring his or her vision.

Prior developments in this field may be generally illustrated by reference to the following information disclosure statement:

U.S. Patent Documents

| U.S. Pat. No. | Patentee | Issue Date |
|---|---|---|
| 5,136,724 | W. Grilliot et al. | Aug. 11, 1992 |
| 5,036,548 | W. Grilliot et al. | Aug. 6, 1991 |
| 3,973,643 | J. Hutchinson | Aug. 10, 1976 |
| 2,979,153 | E. Hoagland et al. | Apr. 11, 1961 |
| 4,076,101 | L. Himmelrich | Feb. 28, 1978 |
| 1,574,529 | S. Abrahma | Feb. 23, 1926 |
| 4,645,033 | H. Oselsclager | Feb. 24, 1987 |
| 3,176,793 | R. Hlacia | Apr. 6, 1965 |
| 112,552 | J. Conley | Mar. 14, 1871 |
| 416,550 | J. Betten | Dec. 3, 1889 |

U.S. Pat. Nos. 5,036,548 and 5,136,724 teach forms of combined firefighters' turnout pants and safety harness.

U.S. Pat. No. 3,973,643 teaches a firefighters' safety coat with detachable harness.

U.S. Pat. No. 2,979,153 teaches a safety suit with built-in harness.

There continues to be a need for a new and improved extrication harness apparatus which addresses the problems of construction, effectiveness and ease of use that are attendant in the prior art. In this respect, the present invention substantially fulfills this need.

SUMMARY OF THE INVENTION

In view of the disadvantages inherent in the known art, the general purpose of the present invention, which will be described subsequently in greater detail, is to teach a new and improved extrication harness apparatus which has all of the important advantages of the prior art and few, if any, of the disadvantages.

Firefighters wear a special turnout suit, the turnout pants of which comprise a fireproof outer shell and a separate thermal-barrier liner. The present invention is a harness strap assembly (hereinafter also referred to as the "harness strap"), similar in function to a climbing harness, that may be suspended from the liner of the pants of a turnout suit. The suit liner, which in the prior art typically has no belt-loops, preferably is modified by the addition of a suspender assembly that supports the harness strap assembly. The suspender assembly may incorporate snaps, suspender-type alligator clips, or hook and loop fastener patches for attachment to the waist area of the suit liner without requiring any structural, invasive or other permanent modification of said thermal-barrier liner. The suspender assembly, or "suspender," provides belt-loops through which the harness strap may be threaded. In this way, the harness strap may be suspended from the liner without violating the integrity of the thermal barrier incorporated therein.

It is to be noted in this regard that the suspender belt-loops do not ever bear the weight of the firefighter, but merely are for positioning the harness around the waist, thighs and crotch of the user during normal wearing of the turnout suit—prior to the need for emergency use.

The suspender assembly comprises a matched pair of front waist and thigh belt-loops straps and a rear yoke. Each front waist and thigh belt-loops strap bears or forms a pair of loops for the harness strap assembly (upper for the waist portion thereof and lower for the thigh portion). The rear yoke forms a pair of upper waist belt-loops and a pair of lower buttock/crotch area belt-loops, again for positioning, holding and supporting the harness strap. The suspender assembly contains non-invasive means for attaching itself to the liner of a turnout suit. "Non-invasive" means, in this context, attaching means which does not itself puncture or otherwise violate the integrity of the thermal-barrier liner.

The harness strap assembly comprises a single length of webbed strap (or, preferably, a securely interconnected bifurcated length having a single common longitudinal centerline) that is wound forward around the user's waist through the four suspended waist belt-loops; thence down through the crotch and back around under the user's buttocks; then through the suspended crotch belt-loops; then back around outside and through the suspended thigh loops on the lower ends of both front waist and thigh belt-loops straps; and finally back forward to the fly area of the liner where it terminates in two looped ends. Adjacent to the fly, on their way first down through the crotch, the crotch portions of the harness strap pass through a pair of carabiner-holding rings, which rings are not stitched or otherwise affixed to the liner. Instead, the two looped ends of the harness strap hold the two rings. The carabiner-holding rings, in turn, may be interlinked with a metal carabiner of conventional design. Preferably, the carabiner will be suspended from a carabiner strap that passes from one ring to the other.

A pair of belt members may be affixed to the waist portion of the harness strap and fastened together into a belt that may be used for cinching the harness strap up at the liner pant waist. The belt is supplied chiefly to keep the apparatus comfortably in place during normal wear. The belt performs the secondary function of keeping the turnout pants up without the need for suspenders. During normal emergency use the belt members do not have to support any of the user's weight. Therefore, they might be made of lightweight, non load-bearing material, and any buckle or other belt fastener means used to keep them together does not have to meet load-bearing safety standards. Alternatively, the belt and its buckle may be strengthened so as to be able to bear some portion of the weight should the user become inverted during a rappel.

There preferably is a load-bearing safety-grade adjustment buckle on the waist portion of a bifurcated harness strap, or other means for adjusting the overall length of the harness strap relative to the girth of the wearer. This typically only needs to be done once, during the very first fitting thereof. It never has to be done during an emergency, or even during normal firefighting operations. In some embodiments of this invention, the belt and the adjustment buckle functions (above) can in effect be combined in a single clasp, such as a double D-ring clasp at the front of the device.

To escape out of a window in a burning building, one need only secure a rope to a suitable fixed structure. Next, the climbing rope is wound through the carabiner (or carabiners) in the normal fashion. The firefighter immediately may rappel down to safety.

There is no need to put the harness on during the time of the emergency, because one automatically encases one's waist and legs in the harness when the turnout pants are put on.

Importantly, as noted above, there is also no need to adjust or tighten the harness during the emergency—when the firefighter may have only precious moments to exit the building. The use of a free-moving single (or interconnected bifurcated) harness strap threaded loosely through strategically placed loops suspended from the pant liner allows the harness to be self-adjusting. Unlike known emergency harnesses, the present harness apparatus automatically tightens up upon receiving the user's weight without binding.

The harness adds little weight to the turnout pants, and, during normal wear, the crotch portions of the harness strap hang loose, so as not to be confining or uncomfortable. Therefore, there is great incentive, and little disincentive, for a firefighter to adopt the modified turnout pants of this invention.

FEATURES AND ADVANTAGES

It is therefore an object of the present invention to provide a new and improved extrication harness apparatus which has all, or nearly all, of the advantages of the prior art, while simultaneously overcoming most of the disadvantages normally associated therewith.

It is another object of the present invention to provide a new and improved extrication harness apparatus which may be easily and efficiently manufactured and marketed.

It is a further object of the present invention to provide a new and improved extrication harness apparatus which is of a rugged, durable and reliable construction and which meets or exceeds known safety standards and codes.

An even further object of the present invention is to provide a new and improved extrication harness apparatus which is susceptible of a low cost of manufacture with regard to both materials and labor, and which accordingly is then susceptible of low prices of sale to firefighters and fire departments, thereby making such a extrication harness apparatus economically available to the buying public.

Still another object of the present invention is to provide extrication harness apparatus wherein the same permits an increased ease of assembly and installation relative to the art.

Another feature is a new and improved extrication harness apparatus that is lightweight, easy to use, unobstructive, unobtrusive in appearance and suitable for mass production.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWING

The invention will be better understood and objects other than those set forth above will become apparent when consideration is given to the following detailed description thereof. Such description makes reference to the annexed drawing wherein.

DRAWING REFERENCE NUMERALS

Figure 1:
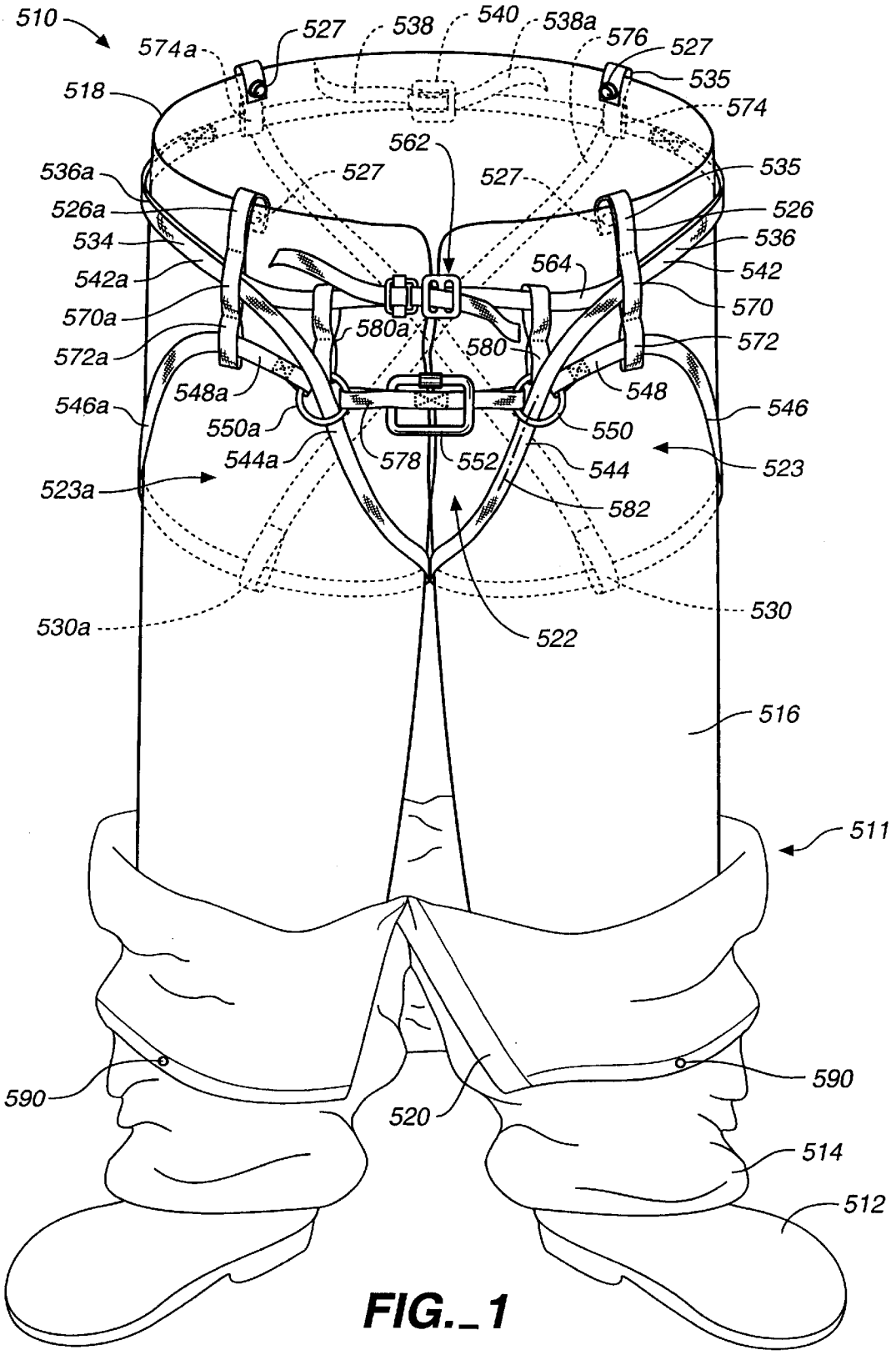
FIG. 1 is a front elevation of a first preferred embodiment of the harness apparatus of this invention, showing the harness strap thereof in an open or first position in the environment of firemen's turnout pants.

510 extrication harness apparatus having suspender assembly
511 turnout pants
512 boots
514 shell
516 liner
518 waist
520 fly
522 crotch
521 first buttock area
521*a* second buttock area
523 first pant thigh
523*a* second pant thigh
526 first front waist and thigh belt-loops strap
526*a* second front waist and thigh belt-loops strap
527 snap
530 first crotch belt-loop
530*a* second crotch belt-loop
534 harness strap assembly
535 suspender assembly
536 first strap member
536*a* second strap member
538 first free end
538*a* second free end
540 adjustment buckle
542 first waist portion
542*a* second waist portion
544 first crotch portion
544*a* second crotch portion
546 first thigh portion
546*a* second thigh portion
548 first looped end
548*a* second looped end
550 first carabiner ring
550*a* second carabiner ring
552 carabiner
562 front buckle assembly
564 belt
565 stitches
570 first front waist belt-loop
570*a* second front waist belt-loop
572 first front thigh belt-loop
572*a* second front thigh belt-loop
574 first rear waist belt-loop
574*a* second rear waist belt-loop
576 rear yoke
578 carabiner strap
580 first ring strap
580*a* second ring strap
582 centerline
583 post
584 socket
586 snap
588 post
590 snap
616 liner
627 suspender-type alligator clip
635 suspender assembly
716 liner
727 interlocking loop material
728 interlocking hook material
735 suspender assembly
786 interlocking loop material It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

Figure 2:
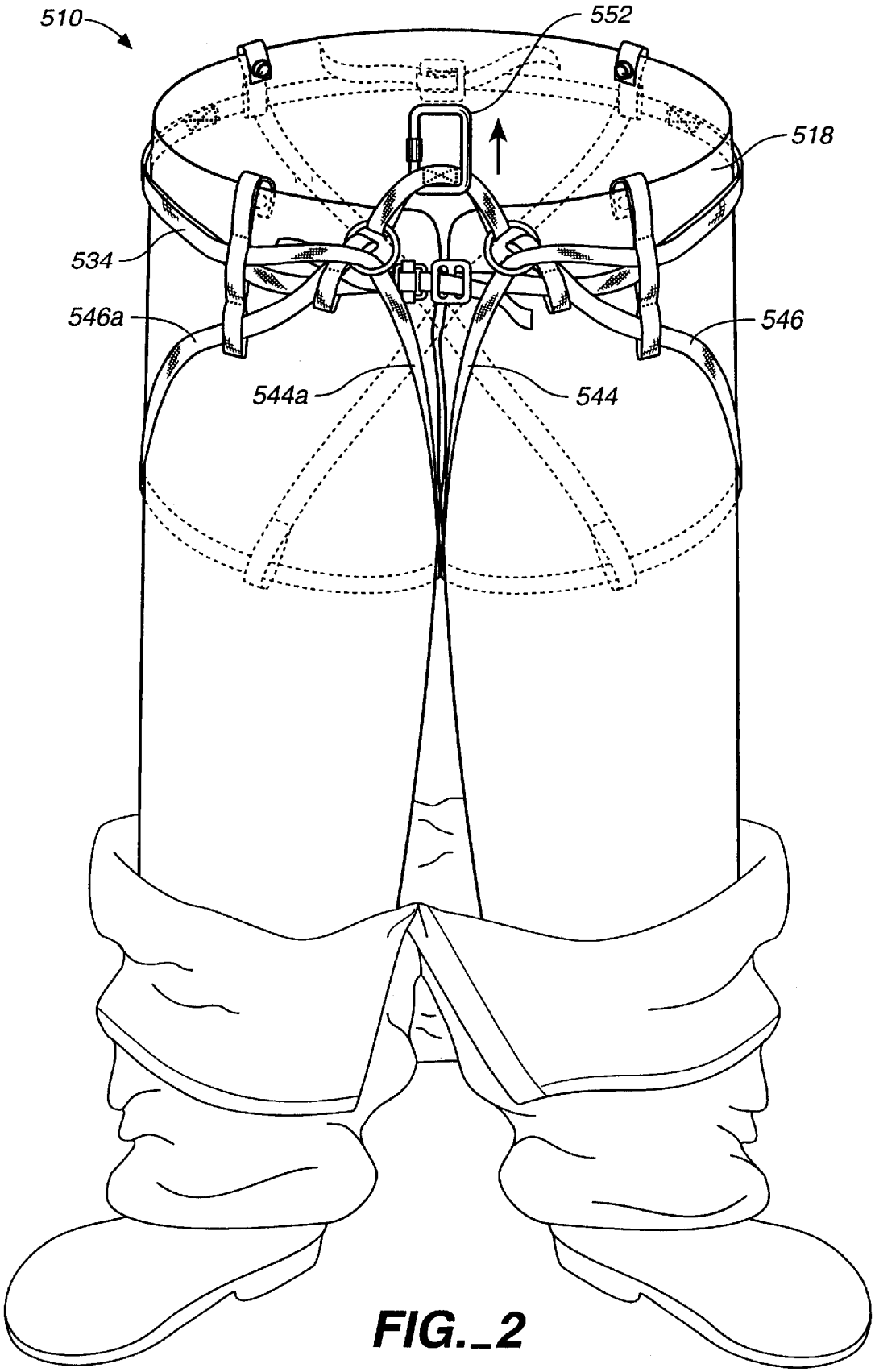
FIG. 2 is a front elevation of the embodiment of FIG. 1, showing the harness strap in a closed or second position.
Figure 3:
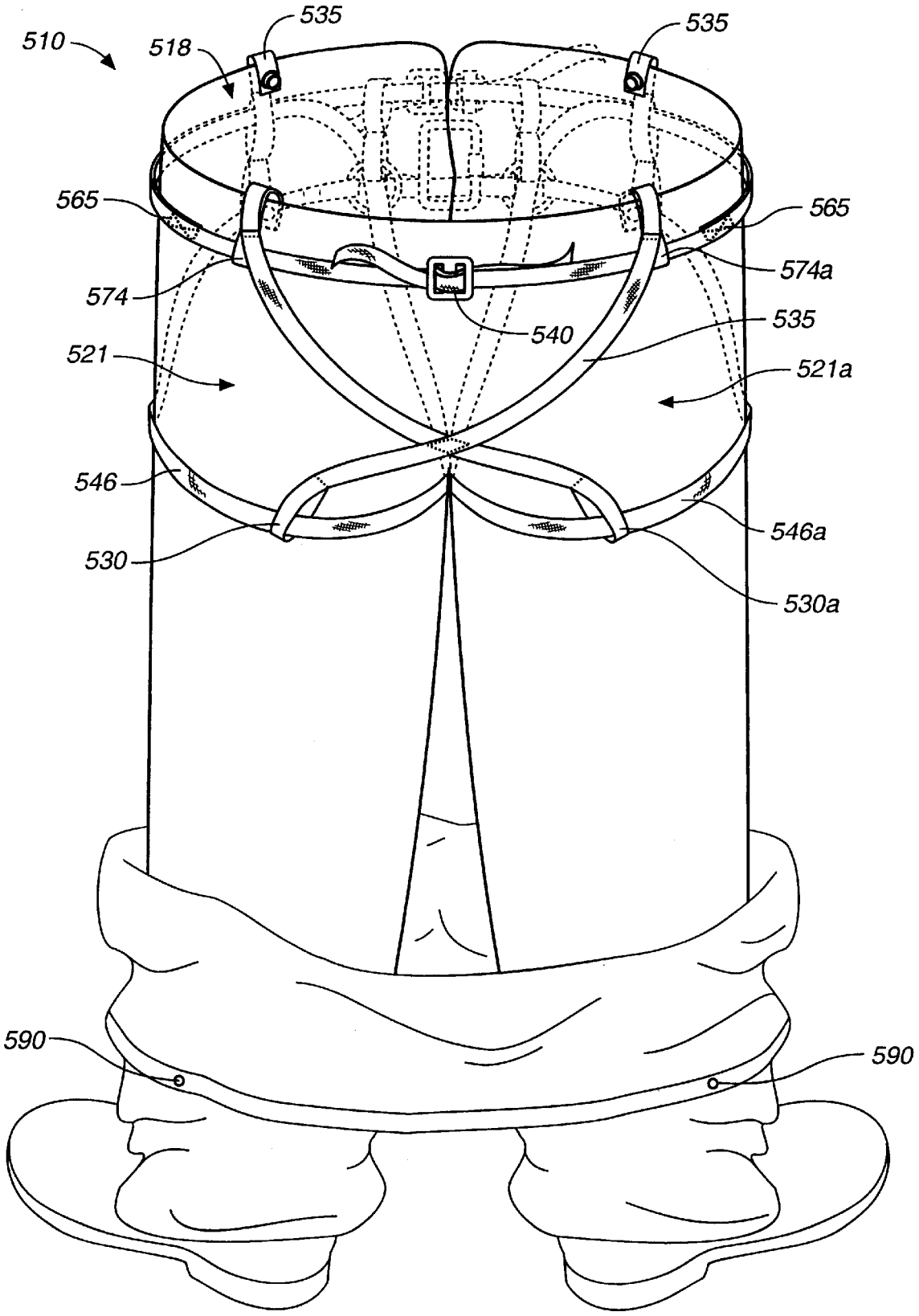
FIG. 3 is a rear elevation of the embodiment of FIG. 1 with the harness strap in the first position.

Referring generally to FIGS. 1, 2, and 3, there is illustrated therein an extrication harness apparatus having suspender assembly 510 of this invention installed in the environment of a firefighter's turnout pants 511. The free-moving harness strap assembly ("harness strap") 534 of the harness apparatus 510 is shown in FIG. 1 in a first (open or rest) position. FIG. 2 shows the harness strap 534 thereof in a second (closed or action) position. FIG. 3 is a rear elevation of the extrication harness apparatus 510, with the harness strap 534 in the first position.

Figure 4:
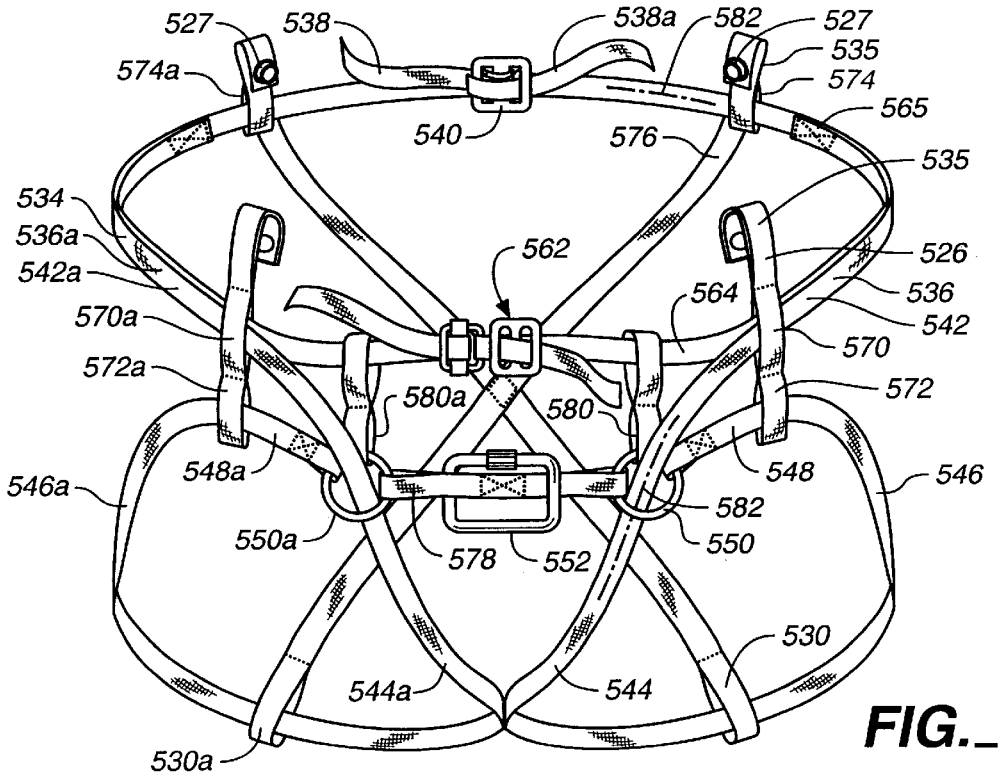
FIG. 4 is a front elevation of the embodiment of FIG. 1, outside of its environment of installation.

FIG. 4 shows the apparatus prior to installation in turnout pants 511.

The extrication harness apparatus having suspender assembly 510 is designed for installation in unmodified turnout pants 511, whose principal parts are a fireproof outer shell 514 and a thermal-barrier insulating fabric liner 516 encased in the shell. A free-moving harness strap 534 is loosely and freely threaded though a series of belt-loops that are sewn, riveted or otherwise affixed to a suspender assembly 535. The suspender assembly 535, in turn, is suspended from the liner 516 using means compatible with the liner's factory-installed attachment means, such as waist snaps (see FIGS. 5–7, below), which are standard equipment on such liners. Installation of the apparatus, therefore, does not require the perforation or other structural modification to the thermal barrier liner 516 that is done during the installation of prior art harnesses, which require, for example, stitching the belt-loops or harness strap in place on the liner or punching extra snaps or the like into the liner for that purpose. Furthermore, the loop-based suspension means of the present invention results in a harness strap assembly that is not fixedly attached or otherwise immobilized (by rivets, stitches, or the like) with respect to any structure at all—which is what is meant herein by the phrase "free-moving."

The pant liner 516 is bounded along its upper edge by its waist area 518, which waist is split in front, forming a fly 520. Below the fly area is a crotch area 522, defined by the juncture of the fly, a first pant thigh area 523, and a second pant thigh area 523*a*. Behind the crotch 522, below the waist 518, the rear of the liner defines a pair of buttock areas 521, 521*a*. Of course, this trouser-like structure of the liner 516 is common in the art.

However, belt-loops typically are absent in prior art turnout suit pant liners, because normally the liners and shells are held together by hook and loop fasteners, snaps or the like and the shells are held up by suspenders. The extrication harness apparatus having suspender assembly 510 of this invention has a regularly spaced series of belt-loops attached to a suspender assembly 535, which suspender is removably attached to the liner 516, preferably through snaps 527. Because these belt-loops never bear any of the user's weight, the suspender 535 may be releasably secured by snaps, hook and loop fasteners, suspender-type alligator clips or the like.

The suspender assembly 535 preferably comprises three separate parts, although these parts could be combined into one piece. Attached to the inner front of the waist 518 of the liner 516 by snaps 527 are a first front waist and thigh belt-loops strap 526 and a second front waist and thigh belt-loops strap 526*a*. The first front waist and thigh belt-loops strap 526 bears or is stitched to form an upper first front waist belt-loop 570 (for the waist portion of the harness strap) and a lower first front thigh belt-loop 572 (for the thigh portion thereof). The second front waist and thigh belt-loops strap 526*a* bears or is stitched to form an upper second front waist belt-loop 570*a* and a lower second front thigh belt-loop 572*a*. The third component of the suspender assembly 535 is a rear yoke 576, preferably shaped in the form of an "X" to properly position its belt-loops. However, other shapes for this yoke would be equivalent, such a the shape of an "H." The upper ends of the rear yoke 576 bear or form a first rear waist belt-loop 574 and a second rear waist belt-loop 574*a*. The lower ends of the rear yoke 576 bear or form a first crotch belt-loop 530 and a second crotch belt-loop 530*a*. The "crotch" belt loops are so named according to their approximate positions, which may range from the rear of crotch 522 to the lower edges of first buttock area 521 and second buttock area 521*a* The rear yoke 576 is attached to the inner rear of the waist 518 of the liner 516 by snaps 527. In other embodiments, the rear yoke may be suspended by other means, such as suspender-type alligator clips, stitches, or the like.

The suspender thus provides the waist 518 of the liner 516 with at least four waist belt-loops that are symmetrically spaced at regular intervals, namely, first front waist belt-loop 570, second front waist belt-loop 570*a*, first rear waist belt-loop 574 and second rear waist belt-loop 574*a*. The liner's first pant thigh 523 is provided with first front thigh belt-loop 572 and the second pant thigh 523*a* is provided with second front thigh belt-loop 572*a*. On opposite sides of the rear of the crotch 522, by the first buttock area 521 and the second buttock area 521*a*, the rear yoke 576 positions first crotch belt-loop 530 and second crotch belt-loop 530*a*.

The harness strap assembly 534 may be made of one continuous piece of strong, flexible webbed or woven cloth material. However, in such a configuration, different size harness straps 534 might have to be provided to accommodate the wide variety of body shapes and sizes of firefighters. Preferably then, the harness strap 534 is bifurcated, namely, it is comprised of a first strap member 536 and a second strap member 536*a*, but it remains a unitary assembly having a single, continuous, longitudinal centerline 582. These strap members 536, 536*a* are at all times securely held together at their un-looped free ends 538, 538*a* by harness strap length adjusting means, such as a safety-tested, rescue-standard adjustment buckle 540.

First waist portion 542 and second waist portion 542*a* (or a single waist portion, not illustrated) of the harness strap 534 are formed adjacent to and on either side of the adjustment buckle 540. The waist portion leads into a first crotch portion 544 and a second crotch portion 544*a*. The crotch portions of the harness strap 534 lead, in turn, to a first thigh portion 546 and a second thigh portion 546*a*. The latter portions terminate in a first looped end 548 and a second looped end 548*a*, respectively. Permanently sewn into the looped ends 548, 548*a* of the harness strap 534 are a pair of circular metal (or strap) rings, namely, the first carabiner-holding ring 550 and the second carabiner-holding ring 550*a*. A carabiner strap 578 is attached by integral end loops between the carabiner-holding rings 550, 550*a*. Releasably affixed to the carabiner strap 578 is a standard metal carabiner 552 of conventional design. The carabiner strap 578 interlocks the carabiner-holding rings 550, 550*a*, and, through them, the looped ends 548, 548*a*—causing the free-moving harness strap 534 itself to form a single loop overall that is intertwined with the new belt-loops of the pant liner 516 in the manner described below.

Sewn by stitches 565 (or riveted, or otherwise affixed) to opposite inner sides of the waist portions 542, 542*a* of the harness strap 534 are a pair of short straps that together form a belt 564. These straps may be fastened together by any suitable belt fastener means, such as front buckle assembly 562 (or double D-rings, water knot, or the like). Preferably, first ring strap 580 and second ring strap 580*a* interconnect the belt 564 with the first carabiner-holding ring 550 and second-holding carabiner ring 550*a*, respectively. The belt 564 may be used to bold the turnout pants 511 up around the user's waist when suspenders become uncomfortable or are disconnected. The belt 564 may also be desired by some users to adjust the harness strap 534 into a more comfortable position during normal firefighting operations. The "inversion" or ring straps 580, 580*a* keep the carabiner strap 578 in a position wherein the carabiner 552 may quickly be located and drawn out through the fly 520 in an emergency. They may also provide additional safety should the firefighter become inverted (head down) during a rappel—in such case, straps 580, 580*a* transfer force to the top belt 564.

The belt 564 and its belt fastener means 562 ordinarily do not bear the weight of the user during an emergency rappel. They need not meet stringent safety standards, and may be made of relatively flimsier material. However, if the inversion function described above is desired, then said belt and buckle fastener should be strengthened to meet such standards.

Beginning at the adjustment buckle 540 at the rear of the extrication harness apparatus having suspender assembly 510, the waist portions 542, 542*a* of the harness strap 534 are threaded through the first rear waist belt-loop 574 and second rear waist belt-loop 574*a*, respectively. In front of the apparatus 510, the first crotch portion 544 and second crotch portion 544*a* pass through either the first front waist belt-loop 570 and second front waist belt-loop 570*a* (as illustrated) or through first front thigh belt-loop 572 and second front thigh belt-loop 572*a* (not illustrated) as comfort dictates. From either of these two sets of loops, the crotch portions dip down and back through the crotch 522 where they pass through the first crotch belt-loop 530 and second crotch belt-loop 530*a*, respectively. Thereafter, the first thigh portion 546 and the second thigh portion 546*a* pass around under the user's buttock areas 521, 521*a* (FIG. 3) and back up and forward through the first front thigh belt-loop 572 and second front thigh belt-loop 572*a*, respectively. The first strap member 536 and second strap member 536*a* then terminate in the first carabiner-holding ring 550 and second carabiner-holding ring 550*a*. Through the metal carabiner-holding rings (or ring-like strap loops) also pass the first crotch portion 544 and second crotch portion 544*a* of the first strap member 536 and second strap member 536*a*, respectively.

Figure 5:
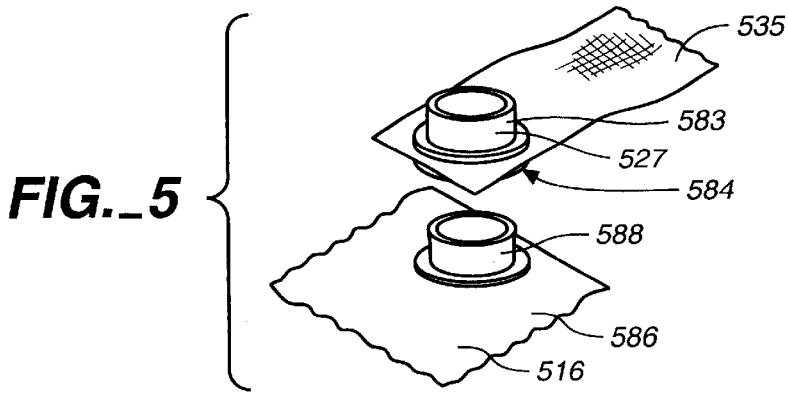
FIG. 5 is broken perspective detail view of a first preferred attachment means.
Figure 6:
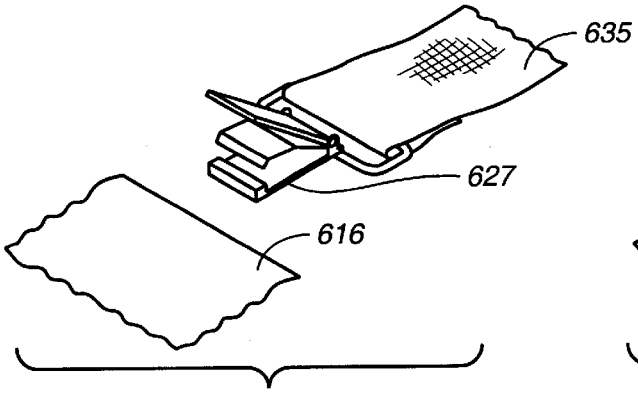
FIG. 6 is broken perspective detail view of a second preferred attachment means.
Figure 7:
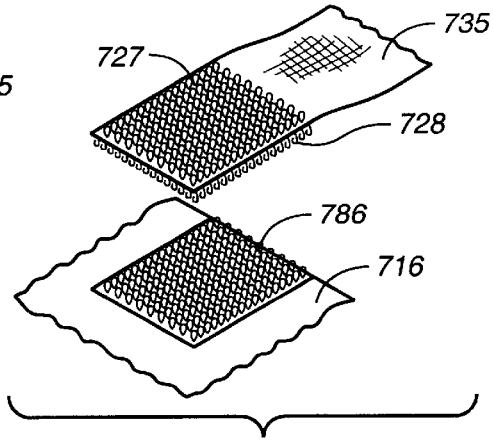
FIG. 7 is broken perspective detail view of a third preferred attachment means.

FIGS. 5–7 illustrate various preferred non-invasive means for attaching a suspender assembly to the liner of a firefighter's turnout pants (invasive means for attaching means for suspending the harness strap assembly include stitches or snaps that are added to the liner for that purpose and pierce it). Turnout pants themselves incorporate various alternative means for attaching the external shell to the liner. Normally, the liner comes with inwardly directed snaps or the like around its waist area. The shell has similarly placed snaps or the like and the shell is attached to the liner by curling it over the top of the liner and inside the waist area, whereupon the liner and shell may be snapped together.

FIG. 5 illustrates the preferred liner attachment means, as used in the embodiment of FIGS. 1–4. The liner 516 has on its inner waist surface a factory-installed snap 586 from which protrudes a post 588. The snaps 527 of the suspender assembly 535 preferably are of the dual function type. That is, each has a socket 584 into which may be inserted the post 588 of the liner snap 586 and each has on its obverse side a matching post 583 of its own. Accordingly, when the snaps 527 of the suspender assembly 535 are snapped onto the snaps 586 of the liner 516, replacement posts 583 are provided for snapping into the sockets of the snaps 590 (FIG. 1) of the shell 514.

FIG. 6 illustrates an embodiment of the invention adapted for use with a liner 616 having no built-in attachment means. Accordingly, the suspender assembly 635 thereof is provided with locking suspender-type alligator clips 627 in order that the suspender assembly may be hung from the liner without violating the integrity of the thermal barrier thereof.

In FIG. 7, the liner 716 has on its inner waist surface factory-installed interlocking loop material 786 (alternatively, interlocking loop material). Hook and loop material on the suspender assembly 735 preferably performs a dual function similar to the embodiment of FIG. 1. That is, one side of the suspender bears patches of interlocking hook material 728 onto which may be grasped the interlocking loop material 786 of the liner 716 and, on the obverse side, bears matching patches of interlocking loop material 727. Accordingly, when the patches of interlocking hook material 728 of the suspender assembly 735 are pressed into engagement with the patches of interlocking loop material 786 of the liner 716, replacement patches of interlocking loop material 727 are provided for engaging hook material on the shell (not illustrated).

Operation

Use of the apparatus to extricate a firefighter or other safety worker from a hazardous emergency situation proceeds as follows.

After donning the apparatus 510 and adjusting the length of the harness strap 534 once by means of the adjustment buckle 540 or other length adjusting means, the apparatus is doffed and set aside. Typically, prior to use the extrication harness apparatus having suspender assembly 510 already will have the firefighter's boots 512 in place in the pant legs of the shell 514 and liner 516 so that all three may be donned simultaneously. Probably, the shell 514 and liner 516 will be lifted up together, but for illustration in FIG. 1 the shell is down, showing the harness strap 534 in a first open position, namely, with the carabiner 552 hanging loose and low at the bottom of the fly, which position it will naturally assume and retain due to gravity. With the shell 514 up, the harness strap 534 will fit so loosely in the first position as not to be noticed by the firefighter during normal operations.

Upon occurrence of an emergency, such as the rapid spread of fire on the floor in which he or she is working, the firefighter may simply take a rope (not illustrated) which has been brought along for such purposes, and tie one end thereof onto a stable fixed portion of the building, such as a pipe, beam or the like, according to rescue systems approved by the State Fire Marshal, OSHA, or the like. Next, the other end of said rope is threaded through the carabiner 552, and coiled thereon the standard number of times. The carabiner 552 may quickly be withdrawn for this purpose through the fly 520 without need to lower the shell 514. The firefighter exits the building through a window (or off the roof), whereupon he or she may rappel in the standard manner down to the ground, or down to a non-burning floor in the case of a highrise building (i.e., one higher than three floors).

FIG. 2 shows the closed or second position that the free-moving harness strap 534 automatically assumes when the carabiner 552 is jerked up by force of the climbing rope thereon. This action pulls the first thigh portion 546 and second thigh portion 546*a* inward and up, as well as the first crotch portion 544 and second crotch portion 544*a*. Such action significantly shortens the effective length of the harness strap 534, tightening it securely and safely around the user's waist, buttocks and thighs, which parts of the body then support the firefighter's weight. No action is required on the user's part to accomplish this tightening, other than applying force to the part of the rope wound around the carabiner 552.

It is important to note that no part of the suspender assembly 535 is fixedly attached to the harness strap assembly. In other words, the harness strap is free to slide or otherwise move along the direction of its centerline 582 with respect to all parts of the suspender 535, being affixed thereto only by means of loose-fitting loops. Accordingly, the harness strap 534 does not bind within the suspender, and it also is free to slide and move with respect to all parts of the liner 516 without binding. With respect to this free-moving function only, the belt-loops holding the harness strap of co-pending U.S. application Ser. No. 09/352,664, the disclosure of which is incorporated by reference herein, provide a means for suspending the harness strap assembly 534 which is equivalent to the suspender assembly 535 hereof. However, the belt-loops of U.S. application Ser. No. 09/352,664 require added stitching or snaps that pierce the liner, thereby possibly violating the heat barrier functions thereof. Accordingly, such fixedly attached belt-loops are not equivalent to the suspender assembly hereof for all purposes.

Therefore, the extrication harness apparatus having suspender assembly 510 is comfortable to wear, even unnoticeable, when not needed, but it automatically and immediately becomes safely and tightly secured in its proper place through free-moving self-adjustment when used.

As to other manners of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

For example, the number of waist belt-loops, crotch belt-loops, thigh belt-loops and the like can be increased or decreased, as desired for safety or comfort. Additionally, the width of such loops could be increased, perhaps to the extent that such loops become strap-encapsulating tube-like structures.

The three parts of the suspender assembly could be unified through further straps, webbing or the like. The carabiner-holding rings could be made of strap material rather than metal and the carabiner strap thereby eliminated.

Also, the preferred strap or belt material is nylon webbing (preferably flattened tubular). However, KEVLAR brand material, or a combination of natural and polymer materials could be substituted therefor.

Therefore, the above description and illustrations should not be construed as limiting the scope of the invention, which is defined by the appended claims.

The invention claimed is:

1. Extrication harness apparatus for a turnout pants liner of the type having a waist area, a crotch area, a pair of thigh areas, and a pair of buttock areas, including:

a harness strap having a single, continuous longitudinal centerline;

a plurality of belt-loops attachable to said liner; and said harness strap threaded through said plurality of belt loops so as, when said plurality of belt loops are so attached to said liner, to pass said centerline around said waist area, down through said crotch area, past said pair of buttock areas, around and up said pair of thigh areas, said harness strap thereby remaining free-moving with respect to all areas of said liner.

2. The apparatus of claim 1 further including:

a carabiner attached to said harness strap.

3. Extrication harness apparatus for a turnout pants liner of the type having a waist area, a crotch area, a pair of thigh areas, and a pair of buttock areas, including:

a harness strap assembly having a single, continuous longitudinal centerline;

means for suspending said harness strap assembly from said liner; said suspending means having a plurality of belt-loops;

means for attaching said suspending means to said liner; and said harness strap assembly threaded through said plurality of belt loops so as, when said suspending means is attached to said liner by said attaching means, to pass said centerline around said waist area, down through said crotch area, past said pair of buttock areas, around and up said pair of thigh areas, said harness strap thereby remaining free-moving with respect to all areas of said suspending means and with respect to all areas of said liner.

4. The apparatus of claim 3 wherein:

said suspending means is a suspender assembly having
first and second front waist belt-loops;
first and second front thigh belt loops;
first and second rear waist belt-loops; and
first and second crotch belt-loops.

5. The apparatus of claim 4 further including:

first and second ends of said harness strap assembly;

a carabiner;

a first carabiner-holding ring attached to said first end; and a second carabiner-holding ring attached to said second end, said carabiner attached to said harness assembly between said first and second carabiner-holding rings.

6. The apparatus of claim 5 wherein:

said carabiner is attached between said first and second carabiner-holding rings by being looped around a carabiner strap that is attached to said first and second carabiner-holding rings.

7. The apparatus of claim 6 further including:

a belt attached to said harness strap assembly.

8. The apparatus of claim 7 further including:

a first strap member and a second strap member bifurcating said harness strap assembly; and an adjustment buckle joining said first and second strap members.

9. The apparatus of claim 8 further including:

first and second ring straps attached to said belt and to said first and second carabiner-holding rings, respectively.

10. The apparatus of claim 4 further including:

a rear yoke of said suspender assembly, said rear yoke having said first and second rear waist belt-loops and said first and second crotch belt-loops;

a first front waist and thigh belt-loops strap of said suspender assembly, said first front waist and thigh belt-loops strap having said first front waist belt-loop and said first front thigh belt-loop; and a second front waist and thigh belt-loops strap of said suspender assembly, said second front waist and thigh belt-loops strap having said second front waist belt-loop and said second front thigh belt-loop.

11. The apparatus of claim 10 wherein:

said rear yoke is X-shaped.

12. The apparatus of claim 4 wherein:

said attaching means is a plurality of snaps.

13. The apparatus of claim 4 wherein:

said attaching means is a plurality of hook and loop fasteners.

14. The apparatus of claim 4 wherein:

said attaching means is a plurality of suspender-type alligator clips.

15. Extrication harness apparatus for a firefighter's turnout pants liner, including:

a bifurcated harness strap assembly having a single, continuous longitudinal centerline;

a suspender assembly having
first and second front waist belt-loops;
first and second front thigh belt loops;
first and second rear waist belt-loops; and
first and second crotch belt-loops;

a plurality of snaps on said suspender assembly; and said harness strap assembly threaded through said belt loops and freely slideable therein and free-moving with respect to all areas of said suspender assembly.

16. The apparatus of claim 15 further including:

first and second ends of said harness strap assembly;

a carabiner;

a first carabiner-holding ring attached to said first end;

a second carabiner-holding ring attached to said second end;

a carabiner strap attached to said first and second carabiner-holding rings; and said carabiner attached to said carabiner strap.

* * * * *